United States Patent [19]

Niguchi et al.

[11] 4,291,781

[45] Sep. 29, 1981

[54] SPEAKER DIAPHRAGM AND METHOD OF PREPARATION OF THE SAME

[75] Inventors: Hirotoshi Niguchi, Kashihara; Mitsuru Ieki, Kyoto, both of Japan

[73] Assignee: Matsushita Electric Industrial Co., Ltd., Osaka, Japan

[21] Appl. No.: 85,204

[22] Filed: Oct. 16, 1979

[30] Foreign Application Priority Data

| | | | |
|---|---|---|---|
| Oct. 17, 1978 | [JP] | Japan | 53/128168 |
| Feb. 9, 1979 | [JP] | Japan | 54/14742 |
| Mar. 13, 1979 | [JP] | Japan | 54/28992 |
| Mar. 20, 1979 | [JP] | Japan | 54/32693 |

[51] Int. Cl.[3] ..... G10K 13/00

[52] U.S. Cl. ..... 181/169; 162/104; 162/145; 162/146; 162/231; 181/170

[58] Field of Search ..... 162/123, 135, 146, 157 R, 162/168 R, 169, 231, 141, 124, 138, 104; 181/167, 169, 170

[56] References Cited

U.S. PATENT DOCUMENTS

| | | | |
|---|---|---|---|
| 3,253,970 | 5/1966 | Williams | 181/169 |
| 3,256,138 | 6/1966 | Welch et al. | 162/127 |
| 3,265,557 | 8/1966 | DeFries | 162/146 |
| 3,907,063 | 9/1975 | Nakazawa et al. | 181/169 |
| 3,930,130 | 12/1975 | Boszor | 181/169 |
| 3,935,924 | 2/1976 | Nagao et al. | 162/141 |
| 3,946,832 | 3/1976 | Takano et al. | 181/169 |
| 3,960,794 | 6/1976 | Sander et al. | 162/146 |
| 4,096,313 | 6/1978 | Fujita et al. | 162/138 |

FOREIGN PATENT DOCUMENTS

| | | | |
|---|---|---|---|
| 51-84248 | 7/1976 | Japan | 162/145 |
| 562604 | 6/1977 | U.S.S.R. | 162/145 |

*Primary Examiner*—Peter Chin

*Attorney, Agent, or Firm*—Stevens, Davis, Miller & Mosher

[57] ABSTRACT

A diaphragm for a speaker which is prepared by heating a conjugated sheet obtained by paper-making polyethylene short fibers with other short fibers which have a high modulus of elasticity, such as carbon fiber, to melt and solidify polyethylene short fibers in the conjugated sheet; the process for the production thereof. The diaphragm for a speaker of the invention has a high modulus of elasticity and a high internal loss and a speaker prepared with such a diaphragm has the advantage of having a wider reproducing frequency response and lower distortion. Furthermore, the process for production of the invention possesses another advantage in that diaphragms for speakers can be produced in a continuous process of successively pressing out the speaker diaphragm with a cold mold press.

9 Claims, 16 Drawing Figures

SPEAKER DIAPHRAGM AND METHOD OF PREPARATION OF THE SAME

The present invention relates to a diaphragm suitable for a speaker, especially for a cone type speaker or dome type speaker and a method of preparation of the same.

The object of the present invention is to provide a diaphragm for a speaker having a high modulus of elasticity and a high internal loss, and the speaker prepared with the diaphragm reproduces a wide frequency response and results in low distortion of the reproduced sound.

Another object of the present invention is to provide a diaphragm for a speaker which makes it possible to produce the diaphragm without any use of binder and this constitutes a significant difference from an ordinary diaphragm for a speaker using a binder to adhere the fiber material in constructing a speaker diaphragm.

Furthermore, another object of the invention is to provide a method of continuous preparation of a diaphragm for a speaker having a cone or dome form.

Heretofore, a diaphragm for a speaker made from paper has been prepared by paper-making raw materials for a diaphragm in a cone form, and drying it in that form as it is. Thus the process is said to be inferior in its processability. According to the process of the invention, at first a long sized conjugated sheet for speaker diaphragm having a flat form is paper-made, and then a diaphragm having a desired form is continuously shaped by successively cold-pressing the sheet after heating.

Heretofore, a diaphragm for a speaker has been made from paper. The reason is that paper has a suitable modulus of elasticity and internal loss and makes it possible to prepare it in light weight. However a diaphragm for a speaker made from paper is limited in its modulus of elasticity within some ranges and cannot give a satisfactory modulus of elasticity. Therefore, it is difficult for a speaker assembled with a diaphragm made from paper to attain an expansion of the width of reproduction frequency band and a reduction of distortion of reproduced sound.

Heretofore, some attempts have been made to improve the modulus of elasticity of paper by using a mixed-paper-making of the diaphragm for a speaker by mixing in an inorganic or organic synthetic fibre with cellulosic fibre, but an improvement in modulus of elasticity could not be achieved.

In recent years with the same object in mind another attempt has been made to form a diaphragm for a speaker by using organic foamed material or metal plate such as aluminum plate etc. in place of paper, but they have defects such as low modulus of elasticity in diaphragm in spite of its light weight or low internal loss and weight increase in metal plate as such.

The invention provides a diaphragm for a speaker eliminating such defects of the prior art through use of different raw materials for a speaker diaphragm in order to obtain a high modulus of elasticity and high internal loss. That is to say, a speaker having a high reproduction frequency band width and low distortion reproduced sound can be attained by the diaphragm for a speaker of the invention.

FIG. 1 is a schematic drawing of equipment for preparing the diaphragm for the speaker of the invention, FIGS. 2 and 3 are sectional views of the diaphragm for the speaker of the invention, FIG. 4 is a diaphragm showing the relationship between the degree of beating of the polyethylene fibre and the modulus of elasticity thereof, FIG. 5 is a diagram showing the relationship between the length of fibre and the modulus of elasticity of polyethylene fibre, FIG. 6 is a diagram showing the relationship between melt index of polyethylene and the paper strength of polyethylene sheet, FIG. 7 is a diagram showing the relationship between the content of the carbon fibres in the diaphragm for the speaker of the invention and the modulus of elasticity, FIGS. 8 to 11 are diagrams showing the relationship between the acoustic pressure and the frequency characteristics of speakers assembled with the diaphragms of the invention, FIGS. 12 and 13 are cross-sectional views of the diaphragm obtained in Reference Examples.

FIG. 14 is a diagram showing the acoustic pressure-frequency characteristics of a speaker assembled with the diaphragm of Example 12, FIG. 15 is a sectional view of a diaphragm obtained in Reference Example shown therein, FIG. 16 is a diagram showing the acoustic pressure-frequency characteristics of the diaphragm shown in FIG. 15.

The invention will be illustrated by way of Examples only for purposes of illustration without any intention of adding any limitations to the invention. The invention should be construced only on the basis of the appending claims.

EXAMPLE 1

Polyethylene fibre having a melt index of 0.7 g/min was dispersed in water in a concentration of 1.5 percent by weight to obtain a slurry. The slurry then was subjected to beat-treatment by a high-speed refiner to obtain short fibres of polyethylene having a fibre length of 0.3 to 0.6 mm and a degree of beating of 200 ml.

Carbon fibres having a fibre length of 6 mm and a diameter of 8$\mu$ were blended with the above mentioned polyethylene short fibres in a blending ratio of 10:90. Then a conjugated paper having a basis weight of 60 g/m$^2$ was made from the slurry by a paper making machine.

After drying the obtained conjugated paper at a temperature of 100° C., the conjugated paper (1) was heated to a temperature of 180° C. by the infra-red ray heater (2) to melt the polyethylene short fibres.

One second after that, the conjugated paper was cold-pressed between the metal molds (3) and (4) (under an air pressure of 10 kg/cm$^2$) to obtain a cone type diaphragm for the speaker.

The obtained diaphragm has a modulus of elasticity of $22\times10^9$ dyn/cm$^2$ and an internal loss of 0.025. FIG. 2 shows the cross sectional view of the obtained diaphragm.

EXAMPLE 2

Using the same polyethylene fibre as used in Example 1, Kevlar (a trademark for aromatic polyamide short fibres manufactured by E. I. Du Pont de Nemours & Co., U.S.A.) was blended with the said polyethylene short fibres in a blending ratio of 15 to 85, and then a conjugated paper of basis weight of 100 g/m$^2$ was prepared using a paper making machine. After drying the paper at 100° C., the paper was heated to 180° C. by an infrared ray heater as in Example 1 to melt the polyethylene short fibres in the paper. The paper is then rapidly cold-pressed in a cold-press to prepare a cone type diaphragm for a speaker.

The diaphragm for a speaker has a modulus of elasticity of $15\times10^9$ dyne/cm$^2$ and an internal loss of 0.035 in the cone part.

A speaker diaphragm was prepared by hot press-adhering a ring shaped edge part to the cone part of the diaphragm.

The edge part was prepared by mixing the polyethylene short fibres as used in Example 1 with acrylic fibre of 3 denier and kraft paper having a beating degree of 650 ml in a mixing ratio of 50:40:10, paper-making a conjugated paper therefrom, impregnating ethylene-vinylacetate emulsion (ratio of ethylene to vinyl acetate=25:75) to the paper to obtain a paper having a basis weight of 60 g/m$^2$, heating the paper and then cold-pressing it into the edge part. The edge part has a modulus of elasticity of $13\times10^9$ dyne/cm$^2$ and an internal loss of 0.080.

EXAMPLE 3

Polyethylene fibres having a melt index of 1.5 g/10 min, were dispersed in water and the obtained slurry was beaten by a high-speed refiner to obtain polyethylene short fibres having a beating degree of 180 ml and a fibre length of 0.5 to 0.2 mm, which short fibres were used in this Example.

Carbon fibres having a length of 6 mm and a diameter of 8μ were blended in a blending ratio of 10 to 90 with the above-mentioned polyethylene short fibres and then a conjugated sheet having a basis weight of 600 g/m$^2$ was paper-made with a paper machine. After drying the sheet at 100° C., it was heated to 180° C. with an infrared ray heater to melt the polyethylene short fibres in the conjugated sheet. One second after heating the conjugated sheet was cold-pressed between the metal molds of the press into a diaphragm having a cone shape.

The diaphragm has a modulus of elasticity of $20\times10^9$ dyne/cm$^2$, an internal loss of 0.030 and a basis weight of 100 g/cm$^2$.

EXAMPLE 4

Polyethylene short fibres as used in Example 1 were also used in this Example. Carbon fibres having a length of 8 mm and a diameter of 8μ were blended with the polyethlene short fibres at a blending ratio of 20 to 80. A conjugated sheet having a basis weight of 90 g/m$^2$ was paper-made from the fibre-blend. The conjugated sheet was impregnated with ethylene-vinyl acetate emulsion (ethylene:vinyl acetate=25:75) in an impregnated weight of 10 g/m$^2$. The sheet was heated to melt the polyethylene short fibres in the sheet and then rapidly cold-pressed with a press to prepare a diaphragm cone for a speaker from the sheet.

The cone part has a modulus of elasticity of $28\times10^9$ dyne/cm$^2$ and an internal loss of 0.032.

A diaphragm for a speaker was made from the cone by hot-press adhering an edge-part as used in Example 2 to the outer periphery of the cone.

Example 5

A cone part of the speaker diaphragm was prepared using alumina fibre having a fibre length of 6 mm and a diameter of 6μ by the same process as in Example 3. The cone part had a modulus of elasticity of $23\times10^9$ dyne/cm$^2$ and an internal loss of 0.22.

Carbon fibres, aromatic polyamide fibre and alumina fibre were illustrated in the above Examples 1-5 as the fibre materials having high modulus of elasticity.

However, other kinds of fibres shown in the following Table 1 can be also used in the invention.

TABLE 1

| Name of Fibre having high modulus of elasticity | Sp. G. | Modulus of Elasticity (dyn/cm$^2$) |
|---|---|---|
| Fibre glass | 2.5 | $8.8\times10^{10}$ |
| Silicon fibre | 2.19 | $7.4\times10^{10}$ |
| Boron coated tungsten fibre | 2.4 | $4.1\times10^{11}$ |
| Boron coated carbon fibre | 2.23 | $4.5\times10^{11}$ |
| Phenol fibre | 1.24 | $1.1\times10^{10}$ |

In Table 2 are tabulated the details of the above Examples 1 to 5 and Reference Examples 1 to 5 illustrating the use of other short fibres.

TABLE 2

| | Polyethylene short fibre | | | Short fibre having a high modulus of elasticity | | | | |
|---|---|---|---|---|---|---|---|---|
| | Degree of beating (ml) | Fibre length (mm) | Melt index (g/10 min.) | Name of fibre | Fibre length and diameter | Content (% by weight) | Modulus of elasticity ($\times10^9$ dyn/cm$^2$) | Internal loss |
| Example 1 | 200 | 0.3 ~ 0.6 | 0.7 | Carbon fibre | 6 mm . 8 μ | 10 | 22 | 0.025 |
| Example 2 | " | " | " | Aromatic polyamide fibre | 3 mm . 12 μ | 15 | 15 | 0.035 |
| Example 3 | 180 | 0.5 ~ 0.2 | 1.5 | Glass fibre | 10 mm . 12 μ | 10 | | |
| | | | | Aromatic polyamide fibre | 3 mm . 12 μ | 5 | 20 | 0.030 |
| Example 4 | " | " | " | Carbon fibre | 6 mm . 8 μ | 20 | 28 | 0.032 |
| Example 5 | " | " | " | Alumina fibre | 6 mm . 10μ | 15 | 23 | 0.022 |
| Reference Example 1 | 380 | 1.9 | 1.0 | Carbon fibre | 6 mm . 8 μ | 15 | 17 | 0.020 |
| Reference Example 2 | 450 | 1.3 | 1.7 | Carbon fibre | 6 mm . 8 μ | 15 | 15 | 0.020 |
| Reference Example 3 | 500 | 0.9 | 5 | Carbon fibre | 6 mm . 8 μ | 15 | 11 | 0.018 |
| Reference Example 4 | 350 | 1.7 | 1.5 | Aromatic polyamide fibre | 3 mm . 12μ | 15 | 8 | 0.030 |
| Reference Example 5 | 400 | 1.0 | 2.5 | Glas fibre | 6mm . 7 μ | 5 | | |
| | | | | Aromatic polyamide fibre | 3 mm . 12μ | 10 | 7 | 0.025 |

The impregnation of ethylene-vinyl acetate into the edge part in Example 2 and to the diaphragm in Example 4 were made for extinction of air permeability and increase in internal loss of the cone. For the same purpose, ionomer resin emulsion or polyurethane resin emulsion etc. other than vinyl acetate emulsion may also be impregnated to the cone. FIG. 4 shows the relationship between the degree of beating and the modulus of elasticity of polyethylene fibre, which was obtained by measuring the modulus of elasticity of sheets prepared by heat-melting polyethylene fibres obtained under several degrees of beating and paper-making the polyethylene fibres. When beating polyethylene fibres, polyethylene fibres were fibrilated in accordance with the degree of beating, and sheets having different modulus of elasticity depending on the degree of twining of the fibrils were obtained. To prepare a diaphragm suitable for a speaker conjugating polyethylene fibre and fibres having high modulus of elasticity, it is necessary to case polyethylene fibre having a degree of beating of 250 ml or less.

FIG. 8 to 11 show acoustic pressure-frequency characteristics of speakers assembled with the diaphragms of Example 1 to 4. Since the diaphragms of the invention attain high modulus of elasticity and high internal losses (modulus of elasticity of $13\times10^9$ dyne/cm$^2$ and internal loss of 0.020), the speaker assembled with the diaphragm of the invention shows a wider reproducing frequency response and a lower distortion of regenerated sound.

The diaphragm of the invention is usable for woofer speakers, squawker, and tweeter for Hi-Fi audio system, and can be processable in a desired form, and thus is moldable even in a dome form.

Next, Examples are illustrated to show the use of a sheet as laminated the above mentioned conjugated sheets as a diaphragm for a speaker.

EXAMPLE 6

The first conjugated sheet was prepared by mixing polyethylene short fibres having a degree of beating of 230 ml (Canadian freeness) and a fibre length of 1 mm or less with carbon fibres (in a blending ratio of 80:20) and paper-making from the above fibres. The carbon fibres used were short fibres having a fibre length of 3 mm and a diameter of 10$\mu$ and made of acrylonitrile and the conjugated sheet has a basis weight of 60 g/cm$^2$.

Figure 12:
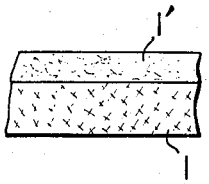
Figure 13:
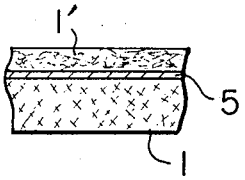

The second conjugated sheet was prepared by mixing aromatic polyamide fibres having a fibre length of 3 mm and a diameter of 10$\mu$ (in a mixing ratio of 85:15) with the above polyethylene short fibres, and paper-making a sheet having a basis weight of 40 g/m$^2$. The first and second conjugated sheets were placed one upon another as shown in FIG. 12, and shaped into cone form by a hot-press. The press was at 160° C. and both conjugated sheets 1 and 1' were heat-adhered to each other.

EXAMPLE 7

A modified polyamide film (5) having a thickness of 20$\mu$ was interposed between two sheets of the conjugated sheet 1 and 1' obtained in Example 6, and hot-press-shaping was carried out in the same manner as in Example 6, to melt the polyethylene and the modified polyamide film to unify the conjugated sheet (1), the modified polyamide film (5) and the conjugated sheet (1').

EXAMPLE 8

An epoxy resin film having a weight of 10 g/m$^2$ was interposed between the two sheets of the conjugated sheet produced in Example 6 to obtain a composite sheet. Then the composite sheet was shaped in a hot-press to melt the polyethylene and at the same time to harden the epoxy resin.

The modulus of elasticity, flexural rigidity and internal loss of the composite sheets obtained in Examples 6 and 7 and were measured and the results are shown in the following as compared with a conventional paper cone.

| Example | Modulus of Elasticity ($\times 10^{10}$dyne/cm$^2$) | Flexural Rigidity ($\times 10^5$ dyne · cm$^2$) | Internal Loss |
|---|---|---|---|
| 6 | 3.2 | 1.5 | 0.0030 |
| 7 | 2.8 | 1.2 | 0.045 |
| 8 | 3.3 | 1.8 | 0.028 |
| Paper Cone | 1.2 | 0.7 | 0.020 |

Figure 1:
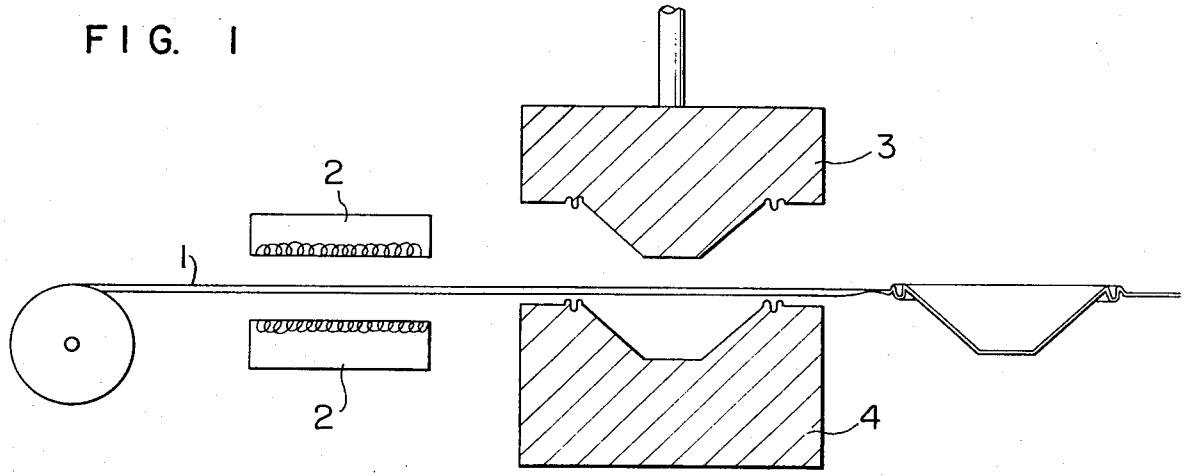
Figure 3:
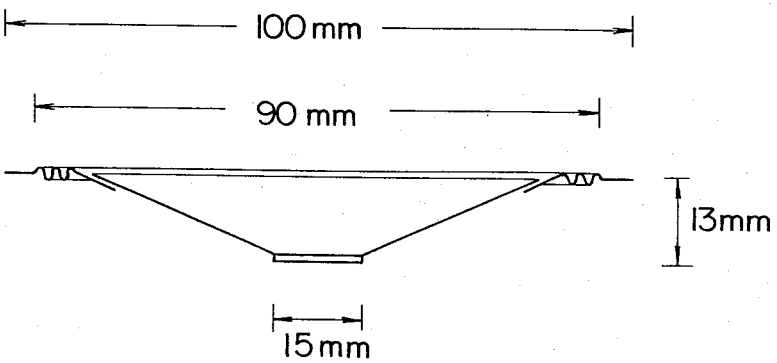
Figure 2:
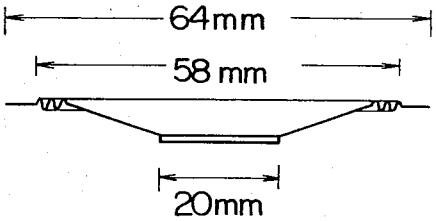
Figure 4:
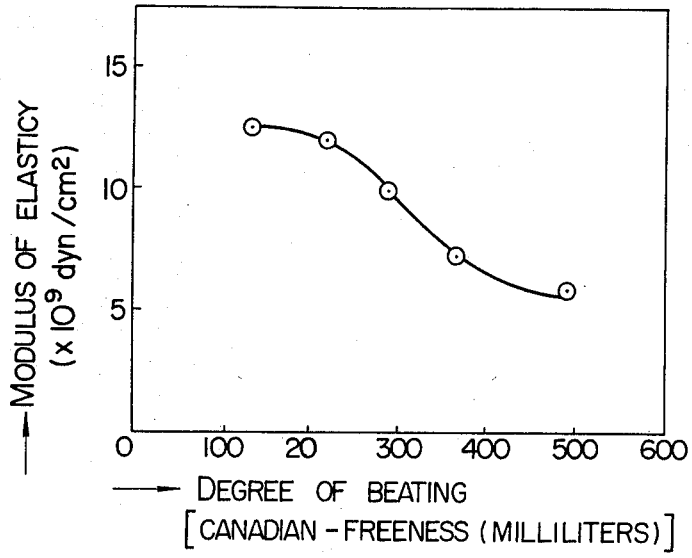
Figure 5:
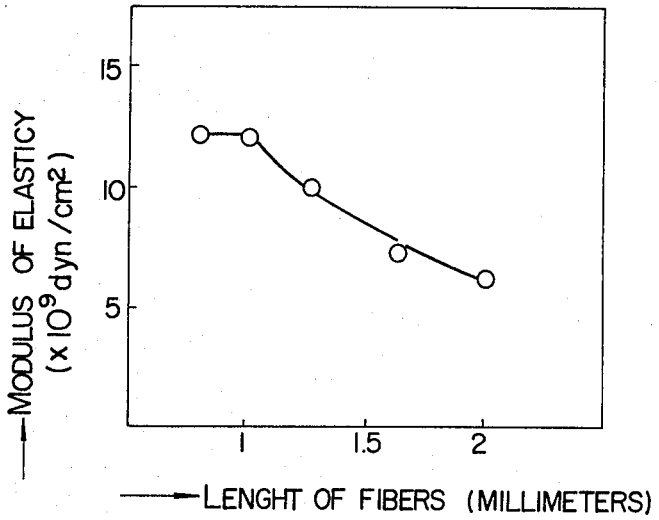
FIG. 5 shows the relationship between fibre lengths of polyethylene fibres and modulus of elasticity which was obtained by measuring properties of sheets prepared by heat-melting various lengths of polyethylene fibre. To prepare a diaphragm suitable for a speaker, the use of polyethylene fibres having a fibre length of 1 mm or less is inevitable.
Figure 6:
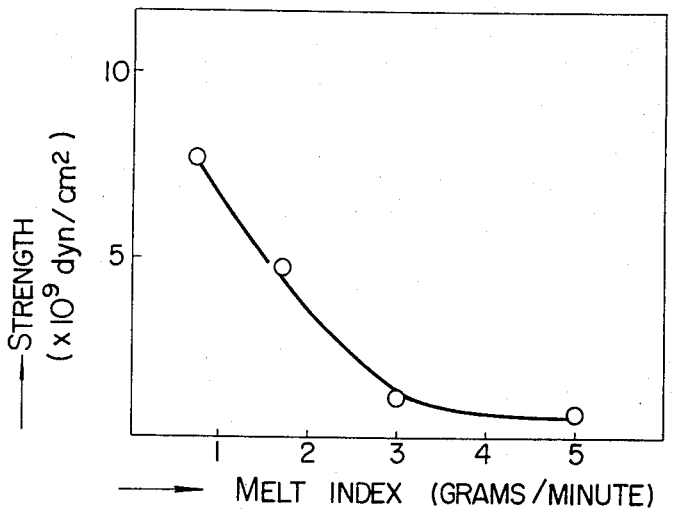
FIG. 6 shows the relationship between the melt indexes of polyethylene fibres and the paper strength of sheets prepared by heat-melting the polyethylene fibres. To prepare a diaphragm suitable for a speaker, the use of polyethylene fibres having a melt index of no more than 2 g/10 min is necessary.
Figure 7:
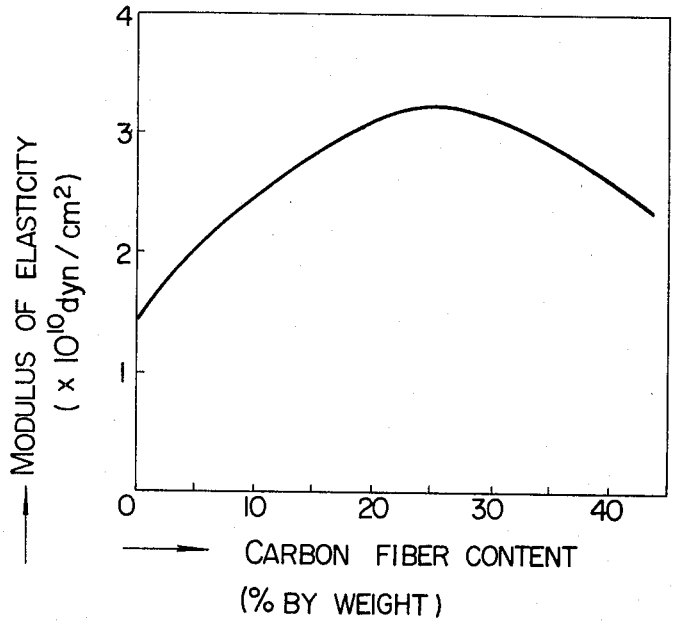
FIG. 7 shows the relationship between the carbon fibre content and modulus of elasticity of the diaphragm and a high modulus of elasticity is revealed in a carbon fibre content between 10 to 40% by weight. However since the processability of the diaphragm becomes inferior beyond the carbon fibre content of 30% by weight, the use of carbon fibre content of 30% by weight or less is preferred.
Figure 8:
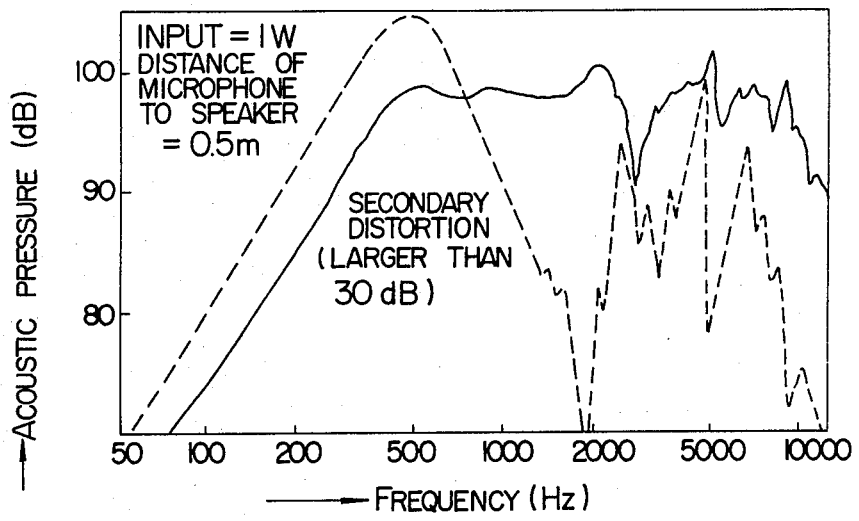
Figure 9:
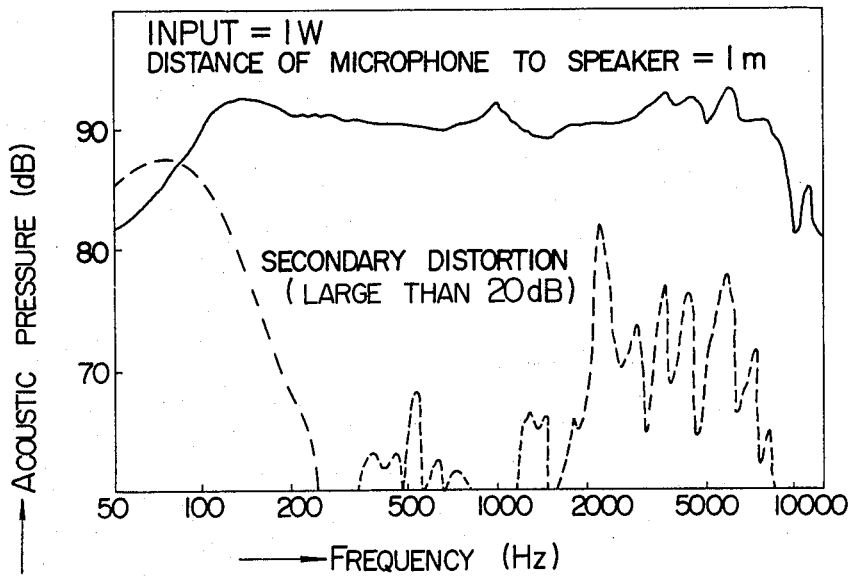
Figure 10:
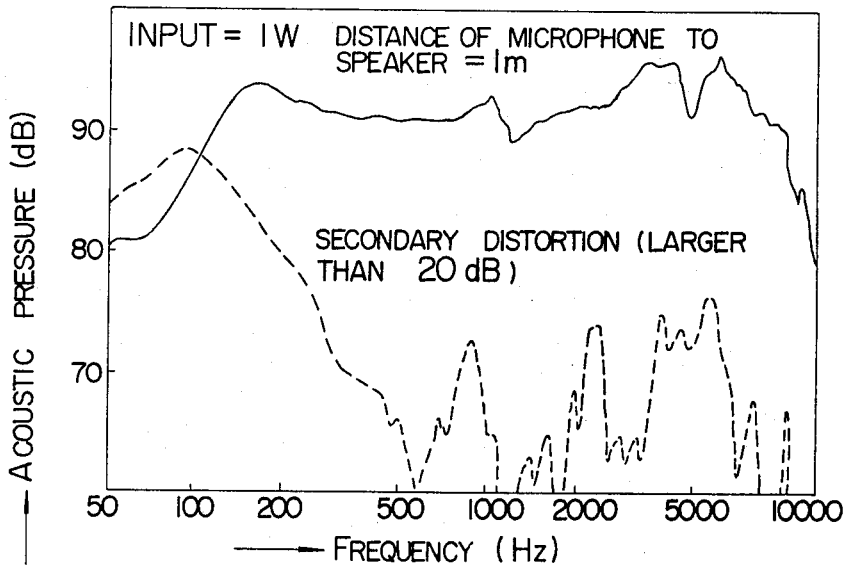
Figure 11:
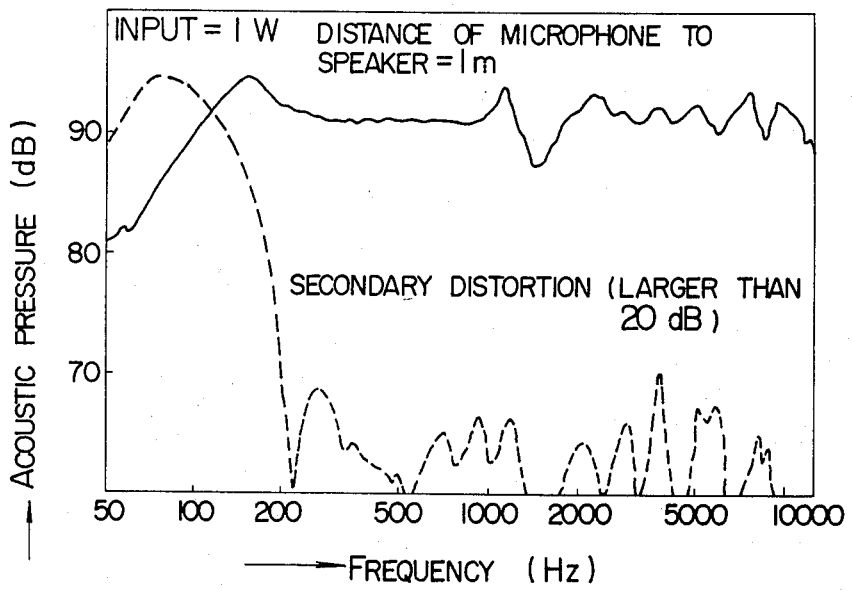
Figure 14:
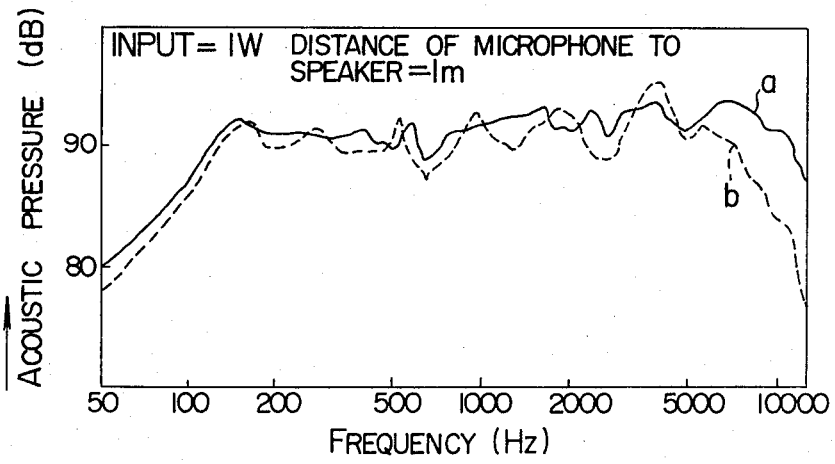
Figure 15:
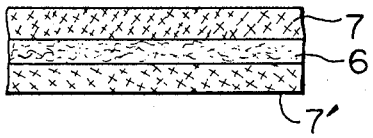

FIG. 14 shows acoustic pressure-frequency characteristics of both a speaker having a diameter of 10 cm made from the diaphragm of Example 6 (a) and a speaker having a diameter of 10 cm using a conventional paper cone (b). As seen from FIG. 6, the speaker using the diaphragm of Example 6 shows a wider reproducing frequency response than that of the ordinary speaker using a paper cone.

EXAMPLE 9

A conjugated sheet was prepared from polyethylene short fibers having a degree of beating of 230 ml (Canadian freeness) and a fibre length of 1 mm and a carbon fibre in a blending ratio of 80:20. The carbon fibre used has a fibre length of 6 mm and a diameter of 10$\mu$. The conjugated sheet has a basis weight of 100 g/m$^2$ and it was used as a surface material of a composite sheet. A core material of the composite sheet was prepared by impregnating ethylene-vinyl acetate (25:75) emulsion into a conjugated sheet made of polyethylene short fibres as used in the surface material and acrylic fibres (in a blending ratio of 50:50). The acrylic fibres were of 3 denier and has a length of 5 mm. The core material had a basis weight of 100 g/m$^2$ and an internal loss of tan $\delta=0.18$.

The surface materials (7) and (7') were laminated on both sides of the core material to prepare a composite paper. The composite paper was heated to laminate the surface on core materials and at the same time was shaped into a cone by a press. The press was heated at 160° C. and the polyethylene short fibres in both materials were melted to produce a strong adhesion between the surface and core materials.

EXAMPLE 10

A composite paper was made using the same surface material as in the preceeding Example and using as a core material a non-woven fabric having a basis weight of 100 g/m$^2$ and made of aromatic polyamide resin. The core fabric has an internal loss of tan $\delta=0.12$.

Hot-press shaping was carried out to melt the polyethylene short fibres in the same manner as in Example 9.

The modulus of elasticities, flexural rigidities and internal losses of the composite papers having the sandwich structure obtained in Example 9 and 10 were as follows.

| Example | Modulus of Elasticity ($\times 10^{10}$dyne/cm$^2$) | Flexural Rigidity ($\times 10^5$ dyne · cm$^2$) | Internal Loss |
|---|---|---|---|
| 9 | 1.4 | 9.4 | 0.043 |
| 10 | 1.8 | 10.5 | 0.035 |
| | (basis weight: 300 g/m$^2$) | | |

Figure 16:
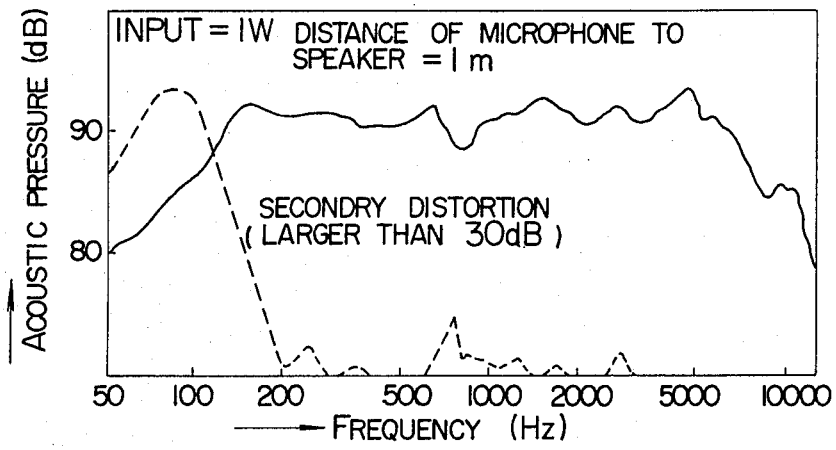

FIG. 16 shows the acoustic pressure-frequency characteristics of a speaker having a diameter of 10 cm made from the diaphragm of Example 9. As seen from FIG. 16, the diaphragm for the speaker obtained in Example 9 shows a narrower range of distortion and a wider range of reproduced frequency response.

What is claimed is:

1. A diaphragm for a speaker, comprising a sheet, paper-made of polyethylene short fibres being present in an amount of 70% by weight or more, said polyethylene short fibers having a degree of beating of 250 ml (Canadian Freeness), a melt index of not more than 2 g/min. and being not more than 1 millimeter in length and other short fibres between 3 and 10 millimeters in length which have a modulus of elasticity of at least $1.1\times10^{10}$ dyne/cm$^2$, said polyethylene short fibers being melted to bond with said other short fibres in said sheet; and said diaphragm having a cone or dome shape imparted by pressing while hot.

2. A diaphragm for a speaker according to claim 1, said other short fibres comprising at least one kind of short fibre selected from the group consisting of aromatic polyamide fibre, glass fibre, silicon fibre, alumina fibre, carbon fibre, boron coated tungsten fibre, boron coated carbon fibre, and phenol fibre.

3. A diaphragm for a speaker according to claim 1, further comprising at least one kind of emulsion, selected from the group consisting of ethylene-vinyl acetate emulsion, ionomer resin emulsion and polyurethane emulsion, impregnated in said sheet.

4. A diaphragm for a speaker, comprising laminated plural sheets, paper-made of polyethylene short fibres being present in an amount of 70% by weight or more, said polyethylene short fibers having a degree of beating of 250 ml (Canadian Freeness), a melt index of not more than 2 g/min. and being not more than 1 millimeter in length and other short fibres between 3 and 10 millimeters in length which have a modulus of elasticity of at least $1.1\times10^{10}$ dyne/cm$^2$, said polyethylene short fibres being melted to bond with said other short fibres in said sheets; and said diaphragm having a cone or dome shape imparted by pressing while hot.

5. A diaphragm for a speaker according to claim 4, further comprising a thermoplastic resin film interposed between said sheets.

6. A diaphragm for a speaker according to claim 5, in which said thermoplastic resin film comprises a modified polyamide film.

7. A diaphragm for a speaker according to claim 5, in which said thermoplastic resin film comprises an epoxy resin film.

8. A diaphragm for a speaker comprising sheets, paper-made of polyethylene short fibres being present in an amount of 70% by weight or more, said polyethylene short fibers having a degree of beating of 250 ml (Canadian Freeness), a melt index of not more than 2 g/min. and being not more than 1 millimeter in length and other short fibres between 3 and 10 millimeters in length which have a modulus of elasticity of at least $1.1\times10^{10}$ dyne/cm$^2$, said polyethylene short fibers being melted to bond with said other short fibres in said sheets; said sheets being thermoadhered on the surface of a core material having a high internal loss; and said diaphragm having a cone or dome shape imparted by pressing while hot.

9. A diaphragm for a speaker according to claim 1, further comprising a ring-shaped edge part adhered to the conical or dome shaped part of the diaphragm.

* * * * *